United States Patent [19]

Schnitzer

[11] 4,008,586

[45] Feb. 22, 1977

[54] KEY ATTACHMENT DEVICE FOR KEY CASE

[75] Inventor: Edmund Schnitzer, Montreal, Canada

[73] Assignee: Renwick of Canada Inc., Montreal, Canada

[22] Filed: Feb. 12, 1976

[21] Appl. No.: 657,478

[52] U.S. Cl. ..... 70/456 B

[51] Int. Cl.[2] ..... A47G 29/10

[58] Field of Search ..... 70/456–459; 150/40; 24/3 K

[56] References Cited

UNITED STATES PATENTS

| | | | |
|---|---|---|---|
| 2,051,432 | 8/1936 | Zahn | 150/40 |
| 2,756,583 | 7/1956 | Thiella | 70/456 B |
| 2,889,697 | 6/1959 | Schumer | 70/456 B |

FOREIGN PATENTS OR APPLICATIONS

| | | | |
|---|---|---|---|
| 244,742 | 5/1947 | Switzerland | 70/456 B |

*Primary Examiner*—Robert L. Wolfe

*Attorney, Agent, or Firm*—Diller, Brown, Ramik & Wight

[57] ABSTRACT

A key attachment device for securing at least one key in a key case or the like receptacles. The device comprises an attachment plate having a hollow housing, which housing is provided with a side wall and disposed in a face of the attachment plate. At least one transverse slot is provided in the side wall of the housing for receiving an attachment end of a key hook member therein. Means is provided for retaining the attachment end of the key hook member in the slot. The attachment end has a tapered shaft portion of circular cross-section, an enlarged head at a free end of the shaft portion, and a key hook secured to the shaft opposite the enlarged head. The shaft tapers in a direction outwardly from the head. The head is retained captive in the hollow housing with the shaft portion protruding through the slot. The tapered shaft portion permits rocking side displacement of the attachment end in the slot and arcuate displacement along the slot.

8 Claims, 7 Drawing Figures

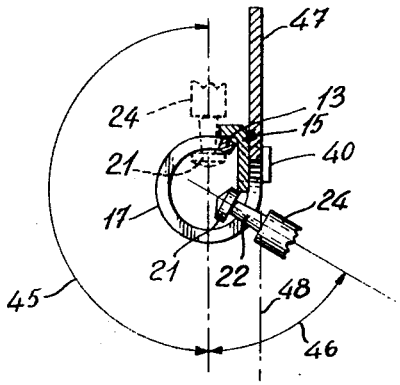
Fig. 5
Fig. 6
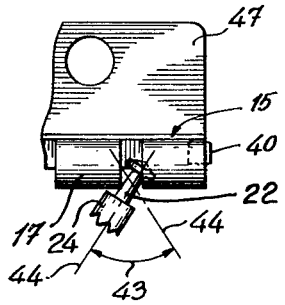
Fig. 7
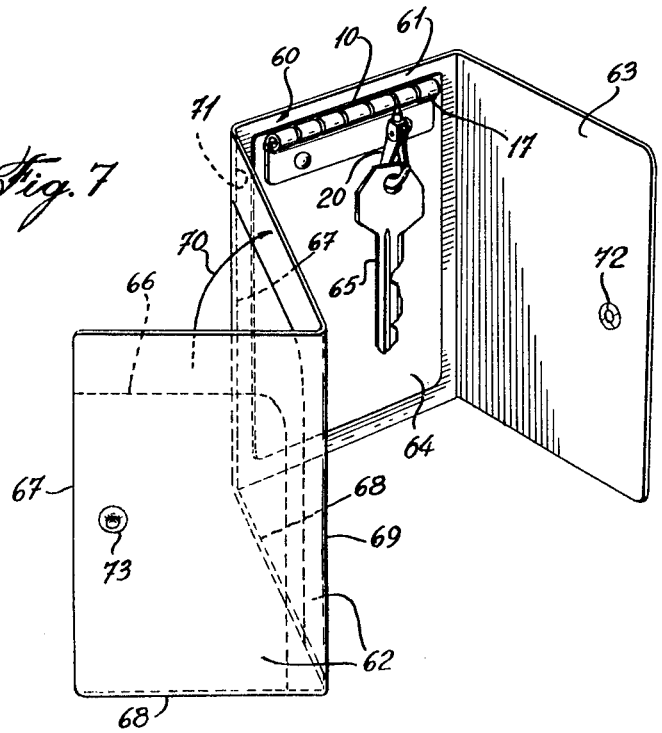

KEY ATTACHMENT DEVICE FOR KEY CASE

BACKGROUND OF INVENTION a. Field of the Invention

The present invention relates to a key attachment device for securing keys in a key case or the like receptacle and more particularly to an improved attachment device of this type.

b. Description of Prior Art

Known types of attachment devices for securing keys in a key case have various disadvantages. One such disadvantage is that certain types of such devices do not provide for the attachment of a sufficient number of keys in a key case due to the construction of the key hook member which does not permit close spacing of the transverse slot in the attachment plate. Another disadvantage is that the key hook member is held in a close-fit relationship in a slot thus permitting restricted displacement in a single plane only and the hook member is subjected to stress when the keys buckle or when a key is manipulated by a person. Also, certain types of key hook members do not permit keys to be overlapped in a key case as there is no lateral or side movement or freedom of swivelling of the key hook member.

SUMMARY OF INVENTION

It is a feature of the present invention to provide an improved key attachment device which substantially overcomes all of the above mentioned disadvantages.

It is a further feature of the present invention to provide a key attachment device which relieves stress on the hook, prevents keys from binding and gives them more freedom to swivel.

It is a still further feature of the present invention to provide a key attachment device which permits the attachment of a greater number of keys in a key case and which makes a more aesthetically appealing key case.

According to the above features, from a broad aspect, the present invention provides a key attachment device for securing at least one key in a key case or the like receptacles. The device comprises an attachment plate having a hollow housing which housing is provided with a side wall and disposed in a face of the attachment plate. At least one transverse slot is provided in the side wall of the housing for receiving an attachment end of a key hook member therein. Means is provided for retaining the attachment end of the key hook member in the slot. The attachment end has a tapered shaft portion of circular cross-section, an enlarged head at a free end of the shaft portion, and a key hook secured to the shaft opposite the enlarged head. The shaft tapers in a direction outwardly from the head. The head is retained captive in the hollow housing with the shaft portion protruding through the slot. The tapered shaft portion permits rocking side displacement of the attachment end in the slot and arcuate displacement along the slot.

BRIEF DESCRIPTION OF DRAWINGS

The preferred embodiment of the present invention will now be described with reference to the accompanying drawings, in which:

FIG. 5 is a fragmented end view of the attachment plate illustrating the displacement of the attachment end of the key hook member in the hollow housing of the key attachment plate;

FIG. 6 is a fragmented plan view of a portion of the attachment plate showing the rocking displacement of the attachment end of the key hook member; and FIG. 7 is a perspective view showing a combination wallet/key case provided with the key attachment device of the present invention.

DESCRIPTION OF PREFERRED EMBODIMENTS

Figure 1:
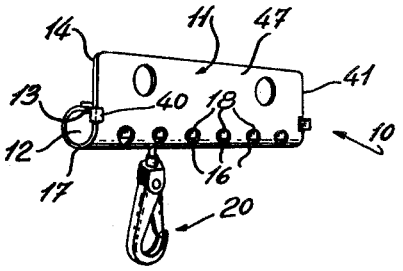
FIG. 1 is a perspective view illustrating an embodiment of the key attachment device of the present invention.

Referring now to the drawings, and more particularly to FIGS. 1 to 4, there is shown, generally at 10, the key attachment device of the present invention. The device comprises an attachment plate 11 having a hollow housing 12 which is formed by curving a lower edge portion of the plate 11 in an arc which is substantially circular in cross-section. The lower marginal edge 13 of the lower edge portion is curved forwardly of a front face 14 of the plate 11 and disposed a short distance from the front face 14 whereby to provide an elongated slot 19 between the marginal edge 13 and the front face 14 to permit passage of a blocking plate 15 therein (see FIG. 4).

A plurality of transverse slots 16 are formed in a side wall 17 of the hollow housing 12 and are spaced equidistantly along the housing 12. Each of the slots 16 has an enlarged open end 18, rearwardly of the housing 12, for insertion and retention of a key hook member 20.

Figure 2:
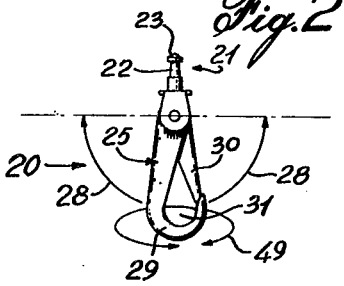
FIG. 2 is a plan view of the key hook member.
Figure 3:
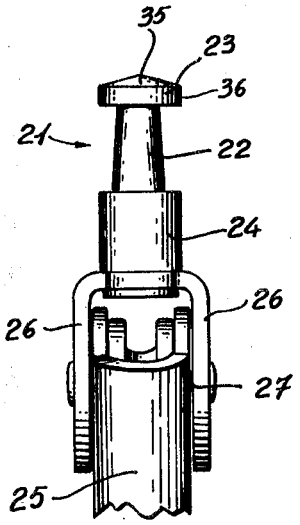
FIG. 3 is an enlarged end view, partly fragmented, of the attachment end of the key hook member of FIG. 2.
Figure 4:
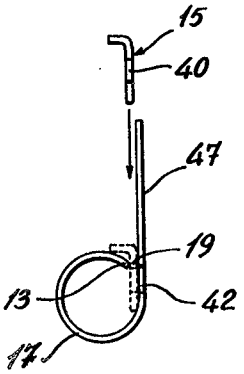
FIG. 4 is an end view showing the component parts of the attachment plate.

As shown more clearly in FIGS. 2 and 3, the key hook member 20 is provided with an attachment end 21. The attachment end 21 has a tapered shaft portion 22, of circular cross-section, and forming an enlarged head 23 at a free upper end thereof. The tapered shaft tapers outwardly from the head 23 and extends to a base portion 24 formed integral therewith and disposed at an end of the shaft opposite to the head 23. The base portion also has a cross-section larger than the largest diameter of the shaft whereby the shaft 22 is recessed between the head 23 and the base portion 24. The largest cross-section of the shaft 22 is smaller than the width of the slots 16 whilst the head and base portion 24 have a cross-section which is larger than the width of the slots 16.

A key hook 25 is pivotally secured to the base portion 24 between a pair of parallel side arms 26 which are movably secured to the base portion 24. A pivot pin 27 permits the key hook 25 to pivot through a 180° arc as shown by the arrows 28 in FIG. 2.

The key hook 25 comprises a hook member 29 defining an open throat which is obstructed by a depressable spring-biased member 30 to prevent one or more key elements (not shown) from sliding out of the key hook member 29 when retained captive in a restricted area 31 rearwardly of the spring-biased member 30.

In order to retain a key hook member 20 captive within a slot 16, the enlarged head 23 of the key hook member 20 is inserted into the enlarged open end 18 of the slot which permits passage of the head 23 therethrough. In order to retain the attachment end 21 within the slot 16, the blocking plate 15 is inserted within the elongated slot 19 whereby the blocking plate obstructs the enlarged open ends 18, as shown in FIG.

1. The blocking plate 15 is provided with end wings 40 which are bent about the end edges 41 of the attachment plate 11 within a recess 42 provided therein. This blocking plate 15 constitutes a means for removably retaining the attachment end 21 of the key hook member 20 in one of the slots 16.

As shown in FIG. 1, the head 23 is retained captive in a slot 16 with the shaft portion 22 protruding through this slot. Referring to FIG. 6, it can be seen that by having the shaft 22 tapered, as described above, and further by making the upper face 35 of the head 23 conical, as shown in FIG. 3, the attachment end 21 may be displaced laterally within the slot 16 to provide a rocking side displacement illustrated by the arrow 43 between the arcs 44 showing the maximum lateral displacements. Also, the shaft 22 can be made relatively short and still provide for a flexible attachment end. The purpose of the conical face 35 is to provide a very narrow vertical side wall 36 in the head 23 to permit increased flexibility of the attachment end 21.

As shown in FIG. 5, the attachment end 21 is capable of arcuate displacement in the slot 16 along an arc of at least 180°. The arrow 45 illustrates a 180° arc. The arrow 46 illustrates the additional displacement of the attachment end beyond the 180° arc 45. The attachment plate rear face 47 is normally secured to a flat surface, illustrated by the plane 48, which is normally flexible and thus additional displacement along the slot is advantageous as when a key case is subject to distortion no stress will be applied on the key and the attachment end 21.

It can also be seen, relative to FIGS. 5 and 6 that the key hook member 20 is also axially rotatable, illustrated by arrow 49, in FIG. 2, when the attachment end 21 is secured in a slot 16. Thus, the key hook 25 is displaceable through an arc of at least 180° along the slot 16, capable of lateral rocking movement relative to the slot 16 as shown in FIG. 6, and further axially rotatable as illustrated by arrow 49. Also, a key can be displaced through a 360° arc.

FIG. 7 shows an example of the use of the key attachment device in a key case. As shown in FIG. 7, the key case 60 is a combination key case and wallet defined by a key case panel section 61 and two wallet panel sections 62 formed integrally with one another. An end flap 63 secures the combination case in a closed condition. A key case back flap 64 is secured to the key case panel section 61. The key attachment device 10 is secured adjacent an upper marginal edge of the panel section 61 and flap 64. Keys 65 are secured to the key hook members 20.

On one side of the wallet section 62, there is provided two flaps, each secured along two marginal edges 67 and 68, respectively. The other edges are open to permit the insertion of paper money therebetween. The wallet panel section 62 folds one on top of the other along their crease line 69 in the direction of arrow 70 to constitute a double panel section which in turn folds along the crease line 71 and lies on top of the panel 61. The end flap 63 then secures the panels in this closed condition by attachment snap tabs 72 and 73 engaging one another.

I claim:

1. A key attachment device for securing at least one key in a key case or the like receptacles, said device comprising an attachment plate having a hollow housing, said housing having a side wall and disposed in a face of said attachment plate, at least one transverse slot in said side wall for receiving an attachment end of a key hook member therein, means for retaining said attachment end in said slot; said attachment end having a tapered shaft portion of circular cross-section, an enlarged heat at a free upper end of said shaft portion, said tapered shaft tapering outwardly from said head, said head being retained captive in said hollow housing with said shaft portions protruding through said slot, said shaft portion permitting rocking side displacement of said attachment end in said slot and arcuate displacement along said slot, said attachment end being further provided with a base portion formed integral with said shaft portion at an end opposite said end having said head, said base portion having a cross-section larger than said shaft whereby said shaft is recessed between said head and said base portion, and a key hook pivotally secured to said base portion between a pair of parallel side arms.

2. A key ring attachment device as claimed in claim 1 wherein said enlarged head has a conical upper surface.

3. A key attachment device as claimed in claim 1, wherein said recessed shaft cross-section is smaller than the width of said slot, said head and said base portion having a cross-section larger than said width of said slot.

4. A key attachment device as claimed in claim 1, wherein said arcuate displacement of said attachment end in said slot extends at least through a 180° arc.

5. A key attachment device as claimed in claim 1, wherein said attachment plate is curved in an arc along a lower edge portion thereof and forwardly of a front face of said plate with its lower marginal edge disposed a short distance from said front face of said plate, said curved lower edge portion forming said hollow housing, a plurality of said transverse slots spaced equidistantly along said hollow housing and each having an enlarged open end for insertion of said head therethrough, said open area being located at a rear end of said slots, and a blocking plate secured to said attachment plate and obstructing said open areas to retain said head of each said attachment ends captive in said hollow housing.

6. A key attachment device as claimed in claim 1, wherein said key hook comprises a hook member defining an open throat and a spring biased member obstructing said throat to prevent one or more key elements from sliding out of a restricted area rearwardly of said spring biased member.

7. A key attachment device as claimed in claim 1, wherein said key hook is pivotal through a 180° arc between said parallel side arms, said hook also being axially rotatable and displaceable relative to said slot through an arc of at least 180°.

8. A key attachment device as claimed in claim 1, wherein said attachment plate has a rear face secured adjacent a marginal edge of a key case, said hollow housing extending above a front face of said attachment plate.

* * * * *